US005814597A

United States Patent [19]

Raehse et al.

[11] Patent Number: 5,814,597

[45] Date of Patent: Sep. 29, 1998

[54] MULTICOMPONENT MIXTURES BASED ON WATER-SOLUBLE ALKALI METAL SILICATE COMPOUNDS AND THEIR USE, MORE PARTICULARLY AS BUILDERS IN DETERGENTS

[75] Inventors: Wilfried Raehse, Duesseldorf; Johann F. Fues, Grevenbroich; Kathleen Paatz; Wilhelm Beck, both of Duesseldorf; Wolfgang Hlavacek, Brunn/Geb., all of Germany

[73] Assignee: Henkel Kommanditgesellschaft auf Aktien, Duesseldorf, Germany

[21] Appl. No.: 700,485

[22] PCT Filed: Feb. 20, 1995

[86] PCT No.: PCT/EP95/00604

§ 371 Date: Oct. 10, 1996

§ 102(e) Date: Oct. 10, 1996

[87] PCT Pub. No.: WO95/23841

PCT Pub. Date: Sep. 8, 1995

[30] Foreign Application Priority Data

Mar. 1, 1994 [DE] Germany ..... 44 06 592.2

[51] Int. Cl.[6] ..... C11D 3/08

[52] U.S. Cl. ..... 510/511; 510/276; 510/452; 510/457; 510/531

[58] Field of Search ..... 510/276, 511, 510/531, 452, 457

[56] References Cited

U.S. PATENT DOCUMENTS

| | | | |
|---|---|---|---|
| 3,838,193 | 9/1974 | Kajitani et al. | 423/351 |
| 3,879,527 | 4/1975 | Bertorelli et al. | 423/332 |
| 3,912,649 | 10/1975 | Bertorelli et al. | 252/135 |
| 3,956,467 | 5/1976 | Bertorelli et al. | 423/332 |
| 4,022,704 | 5/1977 | Balfanz et al. | 510/531 |
| 4,803,327 | 2/1989 | Obara | 219/69 |
| 4,950,310 | 8/1990 | Rieck et al. | 34/295 R |
| 5,096,609 | 3/1992 | Dany et al. | 252/135 |
| 5,236,682 | 8/1993 | Schimmel et al. | 423/334 |
| 5,268,156 | 12/1993 | Schimmel et al. | 423/334 |
| 5,308,596 | 5/1994 | Kotzian et al. | 423/333 |
| 5,338,528 | 8/1994 | Sorensson et al. | 510/531 |
| 5,344,581 | 9/1994 | Beck et al. . | |
| 5,397,507 | 3/1995 | Bauer et al. | 510/457 |
| 5,431,780 | 7/1995 | Raehse et al. | 510/457 |
| 5,501,814 | 3/1996 | Engelskirchen et al. | 252/174.17 |
| 5,536,430 | 7/1996 | Fues et al. | 510/457 |
| 5,547,603 | 8/1996 | Sorensson et al. | 510/531 |
| 5,591,707 | 1/1997 | Raehse et al. | 510/457 |
| 5,597,794 | 1/1997 | Bauer et al. | 510/457 |

FOREIGN PATENT DOCUMENTS

| | | |
|---|---|---|
| 0205070 | 12/1986 | European Pat. Off. . |
| 0320770 | 6/1989 | European Pat. Off. . |
| 0425428 | 5/1991 | European Pat. Off. . |
| 0444415 | 9/1991 | European Pat. Off. . |
| 0488868 | 6/1992 | European Pat. Off. . |
| 0502325 | 9/1992 | European Pat. Off. . |
| 0525239 | 2/1993 | European Pat. Off. . |
| 0542131 | 5/1993 | European Pat. Off. . |
| 0548599 | 6/1993 | European Pat. Off. . |
| 0561656 | 9/1993 | European Pat. Off. . |
| 2143093 | 2/1973 | France . |
| 4030688 | 4/1992 | Germany . |
| 4204035 | 8/1993 | Germany . |
| 4204090 | 8/1993 | Germany . |
| 4206050 | 9/1993 | Germany . |
| 4206495 | 9/1993 | Germany . |
| 4206521 | 9/1993 | Germany . |
| 4208773 | 9/1993 | Germany . |
| 4209432 | 9/1993 | Germany . |
| 4221381 | 2/1994 | Germany . |
| 4234376 | 4/1994 | Germany . |
| 4300772 | 7/1994 | Germany . |
| 4319578 | 12/1994 | Germany . |
| 4330393 | 3/1995 | Germany . |
| 9205849 | 4/1992 | WIPO . |
| WO9308251 | 4/1993 | WIPO . |
| WO9316110 | 8/1993 | WIPO . |

*Primary Examiner*—Jacqueline V. Howard
*Attorney, Agent, or Firm*—Ernest G. Szoke; Wayne C. Jaeschke; Real J. Grandmaison

[57] ABSTRACT

The invention relates to a solid material (primary drying product) containing alkali metal silicate with a modulus (molar ratio of $SiO_2$ to $M_2O$, M=alkali metal) of 0.8 to 4 in homogeneous admixture with other inorganic and/or organic useful materials and/or auxiliaries, which has been dried from a finely sprayed aqueous preparation of mixtures of the alkali metal silicates and the inorganic and/or organic useful materials and/or auxiliaries by means of a hot gas stream. The solid material according to the invention is characterized in that, as a primary drying product in homogeneous admixture with the alkali metal silicate, it contains at least 10% by weight of water-soluble inorganic and/or organic salts, has apparent densities of at least 150 g/l, possesses a microporous absorbent internal structure and has been dried with superheated steam as the hot gas stream. The invention also relates in particular to detergent builder systems based on multicomponent systems containing this overdried alkali metal silicate and to their use for subsequent impregnation with other free-flowing useful materials and mixtures thereof from the field of detergents and to the detergents obtained.

23 Claims, No Drawings

MULTICOMPONENT MIXTURES BASED ON WATER-SOLUBLE ALKALI METAL SILICATE COMPOUNDS AND THEIR USE, MORE PARTICULARLY AS BUILDERS IN DETERGENTS

BACKGROUND OF THE INVENTION

Field of the Invention

This invention relates to solid useful materials and mixtures of solid useful materials based on water-soluble alkali metal silicate compounds which are also known in the specialist literature as waterglasses. This term encompasses the soluble silicates of the alkali metals, more particularly corresponding sodium and/or potassium compounds, which correspond in oxide notation to the composition $xSiO_2 \bullet yM_2O \bullet zH_2O$ (M=alkali metal). The ratio of x to y is termed the modulus. Water-soluble alkali metal silicate compounds of the type with which the invention is concerned have modulus values of about 0.8 to 4.

Waterglasses of the type in question are used for various practical applications. Examples of such applications include adhesives for paper and cardboard; binders for the production of refractory cements, in the enamel industry and building materials industry and as a core binder in the foundry industry; corrosion inhibitors, more particularly for inhibiting the corrosive effect of alkalis on aluminium and zinc; liquefiers for reducing the viscosity of ceramic slips; stabilizers in the peroxide bleaching of paper and textiles; binders for soil and rock stabilization in housebuilding, tunneling and mining and in the humusless grassing of dunes and garbage dumps or even flocculating agents in the conditioning of water. One of the most important applications of waterglasses is their use as components in detergents where they are expected to form various functions which will be discussed in more detail hereinafter.

This brief list of technical applications for waterglasses makes the following basic requirements clear: the waterglasses should be available in the form of a dry, storable and transportable form, but should be easy to dissolve for practical application. In numerous applications, rapid solubility in cold water plays a crucial role. The problem addressed by the present invention is based inter alia on this fundamental requirement. The invention provides a new technical teaching as to how aqueous waterglass solutions of the described type can be inexpensively worked up on an industrial scale into dry products with adequate apparent densities which are nevertheless distinguished by excellent and spontaneous solubility in water, even cold water.

For many applications of this new formulation, this is in itself a significant advance. The teaching according to the present invention goes further than this. In preferred embodiments, it describes waterglass-based useful materials and mixtures of useful materials from the field of detergents, more particularly laundry detergents.

Detergents of the type in question, more particularly corresponding solid concentrates, contain so-called builders or builder systems together with washing-active surfactant compounds as principal components in addition to other typical auxiliaries and additives. In detergents, builders or builder systems perform a number of functions which have changed considerably with the constant changes in the composition, formulation and production of detergents over recent years and decades. Modern detergents now contain around 20 to 50% by weight of builders. Accordingly, builders are among the most important substances for the production of detergents.

In view of this diversity and evolution of detergent systems, builders have to perform many functions which have never been completely or quantitatively defined. However, the main requirements are well documented and include, above all, softening water, enhancing detergency, inhibiting redeposition and dispersing soil. Builders are intended to contribute towards the alkalinity required for the washing process, to show a high absorption capacity for surfactants, to improve the effectiveness of surfactants, to make positive contributions to the properties of solid products, for example in powder form, and hence to have a structure-building effect or even to ease dust emission problems. These various requirements cannot normally be satisfied by a single builder component on its own, so that a system of builders and co-builders is generally used.

For ecological reasons arising out of the eutrophication of waters or the remobilization of heavy metals, phosphorus and/or nitrogen-containing builders or builder systems as detergent components have been the target of considerable criticism with the result that, today, the three-dimensionally crosslinked, water-insoluble sodium alumosilicate, zeolite NaA, is now being widely used, particularly in laundry detergent formulations. Unfortunately, so-called co-builders have to be used on a wide scale with zeolite NaA, particularly in laundry detergents, above all to counteract unwanted incrustations. Polymeric polycarboxylates, more particularly copolymers based on acrylic acid and maleic acid, in conjunction with soda are now widely used for this purpose together with zeolite NaA. Complexing agents are also frequently used.

Discussion of Related Art

Recently, pure silicate-based systems, such as the crystalline disilicates —so-called SKS types—or combinations of such components with soda have also been described for use as builders or co-builders, cf. for example EP-A-0 205 070, EP-A-0 320 770, EP-A-0 425 428, EP-A-0 502 325 and BP-A-0 548 599, which all describe the production of crystalline layer-form sodium silicates. In addition, EP-A-0 488 868 and BP-A-0 561 656 describe combinations of silicates and soluble inorganic salts, such as sodium carbonate, sodium sulfate, sodium borate or perborate, and other compounds of this type as builders.

At the time zeolite NaA was being developed as a builder, it was proposed to use selected water-soluble amorphous sodium silicate compounds as builders in detergents, cf. for example U.S. Pat. Nos. 3,912,649, 3,956,467, 3,838,193 and 3,879,527, which describe amorphous sodium silicate compounds as builders which are produced by spray drying of aqueous waterglass solutions, subsequent grinding and then compaction and spheronizing with additional removal of water from the ground material, cf. for example FIG. 3 of U.S. Pat. No. 3,912,649. The water content of the products used is in the range from about 18 to 20% by weight for apparent densities well in excess of 500 g/l.

EP-A-0 444 415 proposes detergents containing 5 to 50% by weight of at least one surfactant, 0.5 to 60% by weight of a builder and typical detergent ingredients, characterized in that an amorphous low-water sodium disilicate with a water content of 0.3 to 6% by weight is used as the builder. In a preferred embodiment, the amorphous sodium disilicate is said to contain 0.5 to 2% by weight of water. These substantially water-free amorphous disilicates are produced by a multistage process which initially comprises producing a powder-form amorphous sodium silicate with a water content of 15 to 23% by weight. This material is treated with waste gas in countercurrent in a rotary kiln at temperatures of 250° to 500° C. The amorphous sodium disilicate issuing from the rotary kiln is size-reduced by a mechanical crusher to particle sizes of 0.1 to 12 mm and subsequently ground in a mill to particle sizes of 2 to 400 $\mu$m.

By contrast, the teaching of EP-A-0 542 131 seeks to produce a dried sodium silicate containing water of crystallization—suitable for use as a builder component—with a free water content of 5 to 12% by weight in a single process step by treatment of a 40 to 60% by weight aqueous solution of the sodium silicate with hot air in a turbodryer equipped with impact tools. The drying product passes through a pseudoplastic state which is used to produce a product in granular form. The granules are dried under working conditions which rule out the possibility of embrittlement of the outer shell of the granules and, hence, disintegration of the structure of the granules. It is possible in this way—avoiding the so-called "popcorn effect"—to produce, water-soluble sodium silicates with specific gravities of 0.5 to 1.2 which are distinguished by complete solubility in water at ambient temperature.

In the following, the teaching according to the invention is essentially described with reference by way of example to builders or builder components for detergents. As mentioned at the beginning, however, the teaching according to the invention is not confined to this particular field of application although it is particularly suitable for illustrating the characteristic elements of the teaching according to the invention.

The problem addressed by the teaching according to the present invention was to provide waterglasses or waterglass-based multicomponent mixtures in a form which would enable the properties of the end product to satisfy various practical requirements by an inexpensive process which could be carried out on an industrial scale. More particularly, the invention sought to find improved access to highly effective builders or builder systems for detergents and to enable combinations with other auxiliaries and useful materials from the field in question to be directly or indirectly established within the mixture of solids.

DESCRIPTION OF THE INVENTION

In a first embodiment, therefore, the present invention relates to a solid material (hereinafter also referred as the "primary drying product") containing alkali metal silicates with a modulus (molar ratio of $SiO_2$ to $M_2O$, M=alkali metal) of 0.8 to 4 in homogeneous admixture with other inorganic and/or organic useful materials and/or auxiliaries, which has been dried from a finely sprayed aqueous preparation of mixtures of the alkali metal silicates and the inorganic and/or organic useful materials and/or auxiliaries by means of a hot gas stream, characterized in that the primary drying product has apparent densities of at least 150 g/l, possesses a microporous absorbent internal structure and has been dried with superheated steam as the hot gas stream, at least 10% by weight of water-soluble inorganic and/or organic salts being present in homogeneous admixture with the alkali metal silicate.

In another embodiment, the invention relates to builder systems or builder components in detergents which contain the above-mentioned alkali metal silicates with a modulus of 1 to 4 in the form of a spray-dried free-flowing solid with the ability to increase detergency (primary and/or secondary washing power) as an essential component. This embodiment of the teaching according to the invention is characterized in that—in a multicomponent mixture—the alkali metal silicates are present in homogeneous admixture with other useful materials and/or auxiliaries from the field of detergent builders and/or detergent builder components in the form of a granular, pourable and free-flowing dry solid (primary drying product) with apparent densities of at least 150 g/l and a highly porous, absorbent internal structure and have been produced by spray drying of an aqueous preparation of the multicomponent mixture with superheated steam as the drying gas. In this connection, the present invention also relates to solid detergents, more particularly laundry detergents, based on a mixture of surfactants, builder components and other typical auxiliaries and/or useful materials, characterized in that they contain builder components or builder compounds which correspond to the definition given in the following.

In further embodiments, the teaching according to the invention relates to the use of the porous and absorbent mixtures of useful materials from the field of detergent builder components as supports for subsequent impregnation with other free-flowing useful materials and mixtures of useful materials from the field of detergents. Finally, the invention relates to the application of the principle of spray drying with superheated steam as drying gas to the drying and subsequent overdrying of aqueous preparations of alkali metal silicates, more particularly corresponding compounds with a builder effect in detergents, in admixture with other auxiliaries and/or useful materials from the field of builder detergents for the production of a dry granular solid with an absorbent, porous internal structure in which the silicic acid units are present at least by far predominantly as oligosilicic and/or polysilicic acid units, despite which rapid and substantially complete solubility in water is guaranteed.

DETAILED DESCRIPTION OF THE INVENTION

To make the teaching according to the invention easier to understand, key basic concepts are discussed in the following without any claim to completeness. Together, they determine and illustrate the teaching according to the invention.

One crucial basic concept lies in the application of the principle of the drying, more particularly the spray drying, of aqueous preparations of useful materials and mixtures of useful materials with superheated steam as the hot gas stream to the introduction of evaporation energy into the material to be dried and the simultaneous absorption of the evaporated water in the stream of superheated steam and removal of the evaporated water together with the superheated steam removed from the drying zone. The water removed is condensed and conditioned while the rest of the superheated steam is returned in a closed circuit to the drying zone after it has been reheated by the energy removed during drying.

Applicants describe the principle of spray drying of, in particular, useful materials and mixtures of useful materials from the field of wetting agents and detergents in a number of published documents and earlier applications, cf. in particular DE-A 40 30 688 and also DE-A 42 04 035; 42 04 090, 42 06 050; 42 06 521; 42 06 495; 42 08 773; 42 09 432 and 42 34 376. The working principle of drying with superheated steam described therein is hereby specifically included as part of the disclosure of the present invention.

The teaching of the present invention is based on the observation that a summation and multifunctionality of hitherto unknown advantages can be obtained in particular in the drying of water-containing preparations of waterglasses of the type mentioned at the beginning by applying the technology of drying with superheated steam. Without any claim to completeness: the closed superheated steam circuit enables drying to be carried out in the absence of $CO_2$ and thus avoids unwanted secondary reactions in the material to be dried. The drying conditions can be controlled as required in regard to the residual water content. Dry products with residual water contents in the region of the equilibrium value of monomeric alkali metal silicate compounds can be obtained, although it is also possible additionally to eliminate water and, at the same time, to condense the silica residues to oligomer and/or polymer compounds. Virtually any levels of overdrying may be established in the silicate material without any adverse effect on the spontaneous and ready solubility of the dried product in water. Taking into account the tendency of the silica residue towards three-dimensional crosslinking and hence to form poorly soluble to insoluble components in the dry solid, this represents a major advantage for the use of superheated steam as a drying medium. In addition, the primary drying product provided by the process according to the invention accumulates in the form of a free-flowing granular material with considerable apparent densities which, today, are desirable for a number of reasons. Nevertheless, this primary drying product has BET surfaces which are suitable for covering with other useful materials and/or auxiliaries and which go far beyond the calculated outer shells of the granular structure. The reason for this is that the primary drying product accumulates in the form of a material with a microporous, absorbent internal structure which can be filled with sufficiently fluid components in a following step. This microporous internal structure is also crucially important to the dissolving behavior of the dry solid according to the invention.

It will readily be appreciated that the advantages described here can be exploited in the broad range applications of soluble waterglasses mentioned at the beginning. Of particular significance for the field of detergents, particularly laundry detergents, with which the invention is concerned, the builder components based on alkali metal silicates defined in accordance with the invention afford a number of other advantages. More particularly, the fact that the drying process can be controlled in such a way that the material is overdried without affecting its solubility in water optimizes the builder function both in regard to primary washing power and in regard to secondary washing power in the particular detergent. The measure envisaged in accordance with the invention of processing the waterglasses in admixture with other auxiliaries and/or useful materials from, preferably, homogeneous solution—but, if necessary, even from corresponding dispersions—leads to mixtures of useful materials in which the components interacting with one another in practical application are present from the outset in the form of an intimate mixture. Thus, optimized interactions are possible in practice, for example between builder and cobuilder components. The fact that the internal structure of the primary drying product can be covered with other detergent components affords further advantages. For example, the dispersibility of detergent components substantially insoluble in or immiscible with water can be facilitated by the fact that these components are absorbed and dispersed in fluid form in the microporous solids according to the invention.

In the first embodiment mentioned above, the invention relates to a solid called the primary drying product which contains alkali metal silicates with a modulus of 0.8 to 4 in homogeneous admixture with at least 10% by weight, based on the dry weight of the compound—of other inorganic and/or organic useful materials and/or auxiliaries and which has been dried from a finely sprayed aqueous preparation of mixtures of the alkali metal silicates and the other useful materials and/or auxiliaries using superheated steam. The preferred alkali metal silicates are those of sodium and potassium. In the field of detergent builders in particular, over-riding significance attaches to corresponding sodium silicates whereas potassium silicate compounds, for example, can be the preferred compounds for industrial applications.

The alkali metal silicates are preferably present in the primary drying product in quantities of at least 25% by weight and, more preferably, in quantities of at least 30 or 35% by weight (percentages by weight based on the weight of the primary drying product). Particularly important embodiments of the invention contain the alkali metal silicate in quantities of at least 40% by weight and, more particularly, in quantities of at least 50% by weight. Quantities of 45 to 80% by weight and, more particularly, 50 to 75% by weight of alkali metal silicate in the primary drying product can be particularly important. The useful material(s) or auxiliary(ies) used are typically present in quantities of at least about 10% by weight. Depending on the particular application, these second components may make up at least 15% by weight, at least 20% by weight or at least 25% by weight, quantities of 20 to 50% by weight and, more particularly, 30 to 45% by weight of these second components being present in important practical embodiments. Once again, the percentages by weight are based on the weight of the primary drying product.

The second components used as auxiliaries and/or useful materials together with the alkali metal silicates may consist of a certain selected second component, although—taking into account expert knowledge on possible interactions and, in particular, on the particular technical application envisaged — combinations of two or more auxiliaries and/or useful materials may also be used in admixture with the silicate compounds.

A crucial element of the teaching according to the invention is the density of the dry solid which should be sufficiently high without adversely affecting the microporous basic structure. This is a particular feature of the teaching according to the invention which will be discussed in more detail hereinafter. First and foremost, the following figures apply in this regard: the lower limit to the apparent densities required in accordance with the invention is about 150 g/l or 200 g/l. High apparent densities of at least 250 to 270 g/l or even higher, i.e. at least 300 g/l, are often required in practice. Particularly preferred apparent densities are at least 350 g/l and, more particularly, at least 400 to 450 g/l. Although considerable significance attaches to these comparatively high apparent densities in the particular case of spray-dried silicate compounds, the following also applies in this regard: through the secondary impregnation of the primary drying product with other, more particularly fluid, components, the apparent densities can be increased virtually as required into the desired end product ranges. The primary drying product may of course also be compacted in known manner by an aftertreatment, for example by roller compacting, granulation and the like.

Nevertheless, crucial significance attaches to the above-mentioned lower limits to the apparent densities. Thus, it is known that the spray drying of water-containing waterglasses without the addition of second components as a primary drying product results in the formation of extremely light powders in the form of hollow beads with apparent densities of, for example, 50 to 100 g/l. It is known that a hollow bead structure such as this can be destroyed by application of mechanical force which leads to a certain increase in apparent density in the "secondary" drying product. Parallel works carried out by applicants have shown that, even where superheated steam is used as the drying gas, aqueous alkali metal silicate solutions dry to form a light powder in the form of hollow beads without the addition of second components. For the use of superheated steam as drying medium, this is basically surprising, as discussed in detail in applicants' parallel application P 44 06 591.4. By contrast, the teaching according to the present invention is based on the observation that, in the formation of waterglass-based compounds in accordance with the teaching of the invention, even the apparent densities of the primary drying product increase to the comparatively high levels often required in practice. Nevertheless, a microporous internal structure with a considerably enlarged surface remains intact. Accordingly, even from the point of view of its physical characteristics, the granular material obtained in accordance with the invention is totally different in structure from the hollow bead structure of the products dried from pure or substantially pure waterglass solutions.

One important embodiment of the teaching according to the invention is characterized in that the access of $CO_2$ to the drying zone or the formation of $CO_2$ in situ in the drying zone is almost completely ruled out. This is achieved on the one hand by reheating the circulating stream of superheated steam by indirect introduction of energy, as described in the literature on drying with superheated steam. In one particular embodiment of the teaching according to the invention, however, it is also ensured through the choice of the starting materials that no significant amounts of $CO_2$, if any, can be formed by in situ reaction, as is the case for example where alkali metal bicarbonates are used. At all events, it is possible to ensure that no significant amounts of water-insoluble or substantially water-insoluble material, if any, are formed, even in the modified embodiment discussed hereinafter in which an overdried waterglass is produced. The percentage content of insoluble material in the product dried in accordance with the invention is preferably less than 3% by weight and more preferably less than 1% by weight. Complete solubility of at least the alkali metal silicate component is generally ensured. The overall solubility of the dry solid formed is of course also determined by the solubility parameters of the second and third components of which the characteristics will be described in detail hereinafter.

In one important embodiment of the invention, the step of drying the aqueous waterglass-based mixtures comprises the so-called overdrying of the alkali silicate material. Based on sodium silicates with the modulus range of about 1.3 to 4 typical of detergents, this means that the residual water contents in the sodium silicate component are adjusted to values below 18% by weight and, more particularly, to values below 15% by weight. Dry solids with water contents of the silicate component of at most 15% by weight are particularly suitable, particular significance attaching to water contents in the sodium silicate of around 1 to 13% by weight and, more particularly, around 3 to 10% by weight. One important embodiment is characterized by the use of overdried X-ray amorphous alkali metal silicates, more particularly sodium silicates, with modulus values in the above-mentioned range and water contents in the primary drying product of around 6 to 13% by weight or up to 15% by weight.

As known to the expert, these drying results are achieved through the process parameters of the drying stage using superheated steam and, in particular, through the temperature level of the steam introduced, its quantity and/or the residence time of the material in contact with the superheated steam. The more rigorous the drying conditions, the higher generally the degree of overdrying of the product. An important process parameter which is very easy to control in this regard is the temperature of the superheated steam as determined by its entry temperature and its exit temperature. Depending on the sensitivity of the material to be overdried and the intended drying result, the entry temperature of the superheated steam may be selected within a broad temperature range, for example from 120° to 450° C. and preferably from around 150° to 380° C. The exit temperature of the superheated steam laden with the evaporated water is correspondingly lower, preferred exit temperatures being for example in the range from about 115° to 220° C. and more particularly in the range from 130° to 200° C. As already mentioned, the choice and adaptation of the particular working conditions is determined in particular by the sensitivity of the materials to heat, more particularly the other auxiliaries and/or useful materials sprayed together with the alkali metal silicates, and by the required drying result in the dry end product. If substantial overdrying of the alkali metal silicate is required as an indirect result of spray drying, it will generally be useful to select comparatively high entry temperatures of the superheated steam, for example in the range from 280° to 380° C., and also to keep the steam exit temperatures comparatively high, for example in the range from 180° to 240° C. However, it will readily be appreciated that the invention also enables spray drying to the primary drying product to be carried out under comparatively mild conditions with only limited overdrying of the alkali metal silicate and to complete formation of the overdried alkali metal silicate in a following thermal stage, for example by heating at elevated temperatures.

More particularly, the maximum temperature of the material under the drying conditions, which may be in the range from 100° to 200° C. and more particularly in the range from about 110° to 150° C. for example, can also assume particular significance in this regard. However, the residence time of the material at temperatures as high as these should be only a matter of seconds so that product damage can be reliably prevented, even when temperature-sensitive constituents are used as mixture components. Such reservations do not apply at all in cases where, for example, temperature-stable inorganic salts of the sodium sulfate or sodium carbonate type are used as mixture components. It is precisely where the products according to the invention are used as detergent builder compounds that important embodiments are to be found in this regard. The heat to which the purely inorganic material is exposed in the drying zone can be safely controlled to achieve optimized overdrying of the alkali metal silicate.

Through the overdrying of at least a substantial proportion of the alkali metal silicate, oligomer or polymer structures of the silicic acid units are formed in the overdried material. By virtue of the high solubility in water of the dry solids according to the invention, it may be assumed that these oligomeric or polymeric silicic acid units substantially correspond to the so-called $Q_2$ and/or $Q_3$ structure, i.e. have a chain-like or ring-like or flat structure, but are not three-dimensional crosslinked ($Q_4$ state). In preferred products of the teaching according to the invention, at least 50% by weight and preferably at least 80% by weight of the alkali metal silicate component are present as overdried material with an oligomer or polymer structure of the silicic acid units.

Components at least partly soluble in water are preferred as mixture components for drying together with the waterglasses in accordance with the teaching of the invention, so that genuinely homogeneous mixtures with the microporous structure are formed during the dryingprocess. However, fine-particle insoluble mixture components can of course also be at least partly incorporated in the dry solid formed.

These second components of the mixtures according to the invention may be both inorganic and organic in character. Their choice and their characteristics are determined by the particular application envisaged for the dry solid. This is illustrated by the following exemplary observations which again are made without any claim to completeness:

It may be desirable to have virtually the pure alkali metal silicate component available as an active substance in the end product or rather during its redissolution. For example, an inorganic or even an organic, preferably readily water-soluble neutral salt, which does not perform any function of its own in the stage of using the redissolved dry solids, may be used for the step of drying in superheated steam as defined in accordance with the invention. A typical example of such a salt are the alkali metal sulfates, more particularly sodium sulfate.

In many cases, however, it will be desirable to achieve additional effects for the application envisaged for the dry solids through these very mixture components. Thus, for detergent builders for example, the principal builder component, the alkali metal silicate, may be accompanied by other similarly, and optionally, synergistically acting cobuilder components. In the most simple case, the cobuilder components in question are, for example, alkali metal carbonates, more particularly sodium carbonate. The synergistic enhancement of the effect of builder combinations of dried mixtures of sodium silicates with suitable modulus ranges, which will be discussed hereinafter, and soda as a multifunctional mixture in detergents is described, for example, in EP-A-0 488 868 and in EP-A-0 561 656 which were cited at the beginning. According to these documents, corresponding mixtures additionally available as a compact system with a limited surface to the complex mixture of active substances in detergents are obtained by a comparatively time-consuming and labor-intensive process. By contrast, not only is the production of corresponding builder/ cobuilder mixtures in accordance with the invention easy to carry out on an industrial scale, the microporous dry solid affords the additional advantage of a microporous internal structure and hence the possibility of additionally introducing substantial amounts of other detergent components into the dry solid.

The situation described herein with reference to soda as the second component is the same where organic cobuilder components, for example sodium citrates or other alkali metal salts of, in particular, polybasic carboxylic acids, are used. In addition, inorganic and organic cobuilder components may be used together in homogeneous admixture with the waterglass. The corresponding dry solids for their part may again be used as carrier beads for the application of other washing-active components, for example for the application of nonionic surfactants and the like.

Taking the particular application envisaged into account, water-soluble inorganic salts may quite generally be used as inorganic mixture components, corresponding carbonates, bicarbonates, sulfates, halides, borates, phosphates and/or polyphosphates, more particularly in the form of the corresponding sodium and/or potassium salts, being particularly suitable.

The use of organic, preferably at least partly water-soluble mixture components is adapted to the application envisaged. So far as detergent builders are concerned, useful organic builders are, for example, the polycarboxylic acids preferably used in the form of their sodium salts, such as citric acid, adipic acid, succinic acid, glutaric acid, tartaric acid, sugar acids, amino-carboxylic acids, nitrilotriacetic acid (NTA), providing they are ecologically safe to use, and mixtures thereof. Preferred salts are the salts of the polycarboxylic acids, such as citric acid, adipic acid, succinic acid, glutaric acid, tartaric acid, sugar acids and mixtures thereof.

Other suitable builders are polymeric polycarboxylates, for example the sodium salts of polyacrylic acid or methacrylic acid, more particularly those with a relative molecular weight of 800 to 150,000 (based on acid). Suitable copolymeric polycarboxylates are, in particular, those of acrylic acid with methacrylic acid and of acrylic acid or methacrylic acid with maleic acid. Acrylic acid/maleic acid copolymers containing 50 to 90% by weight of acrylic acid and 50 to 10% by weight of maleic acid have proved to be particularly suitable. Their relative molecular weight, based on free acids, is generally in the range from 5,000 to 200,000, preferably in the range from 10,000 to 120,000 and more preferably in the range from 50,000 to 100,000. Biodegradable terpolymers, for example those containing salts of acrylic acid and maleic acid and also vinyl alcohol or vinyl alcohol derivatives (see German patent application P 43 00 772.4) as monomers or those containing salts of acrylic acid and 2—alkyl allyl sulfonic acid and also sugar derivatives (see German patent application P 42 21 381.9) as monomers, are also particularly preferred.

Other suitable builder systems are oxidation products of carboxyfunctional polyglucosans and/or water-soluble salts thereof which are described, for example, in International patent application WO-A-93/08251 or of which the production is described, for example, in International patent application WO-A-93/16110 or in earlier German patent application P 43 30 393.0.

However, in addition to or instead of the second components mentioned thus far, it is also possible to use other known useful materials from the field of builder systems, for example crystalline layer silicates or even limited quantities of water-insoluble zeolites in detergent quality, more particularly zeolite NaA. According to the teaching of earlier German patent application P 43 19 578.4, alkali metal carbonates may even be replaced by sulfur-free $C_{2-11}$ amino acids optionally containing another carboxyl and/or amino group and/or salts thereof. For example, alkali metal carbonates may be at least partly replaced by glycine or glycinate.

However, totally different active-substance components from the field of detergents are potential additional candidates for mixing with the principal builder components based on waterglass for subsequent drying with superheated steam in accordance with the teaching of the invention. Thus, components which have a positive effect on the removability of oils and fats from fabrics by washing may also be used. This effect becomes particularly clear when a fabric, which has already been repeatedly washed with a detergent according to the invention containing this oil—and fat-dissolving component, is soiled. Preferred oil—and fat-dissolving components are, for example, nonionic cellulose ethers, such as methyl hydroxypropyl cellulose containing 15 to 30% by weight of methoxyl groups and 1 to 15% by weight of hydroxypropyl groups, based on the nonionic cellulose ether, and the polymers of phthalic acid and/or terephthalic acid or derivatives thereof known from the prior art, more particularly polymers of ethylene terephthalates and/or polyethylene glycol terephthalates.

The components based on alkali metal silicates dried and, in particular, overdried in accordance with the invention are generally distinguished as dry products by their X-ray amorphous character. Amorphous alkali metal silicates have long been used in detergents, their function essentially being to provide the alkalinity required for the washing process. In commercial detergents, amorphous sodium silicates are used in the form of spray-dried waterglasses with a modulus (molar ratio of $SiO_2$ to $Na_2O$) of around 2 to 3.5. These solid powders normally contain around 18 to 20% by weight of water and are distinguished inter alia by the fact that they have only a very small specific BET surface (DIN 66131) of well below 5 $m^2/g$. Their cumulative volume, as determined by mercury porosimetry measurements (in accordance with DIN 66133), is also very small, normally reaching values of up to 50 $mm^3/g$. The absorption capacity of these spray-dried waterglasses for liquid components, for example nonionic surfactants, is extremely low. Even additions of 5% by weight of the nonionic surfactant cause the solids to lose their powder properties and to stick to one another. Although the fine-particle solid builders now used in accordance with the invention may overlap with the corresponding values of commercial waterglasses in solid form in a number of parameters, they differ fundamentally from these commercial waterglasses in the sum total of their properties.

The builder components according to the invention are X-ray amorphous sodium silicates with a modulus in the range from 1 to 4 typically used in the field in question, more particularly in the range from 1.3 to 3.7. Particular significance attaches to modulus values of at least 1.5 and, more particularly, in the range from 1.5 to 3.3. Preferred other lower limits for the modulus range are 1.7 and, more particularly, 1.9 while other preferred upper limits to the modulus values are 3.0 and, more particularly, 2.7. Hitherto, particular significance has been attributed to modulus values of around 2 (i.e. to the disilicate compounds) in the practical application of amorphous waterglasses in solid form in detergents. Waterglasses with this modulus value are also suitable for the purposes of the invention. However, important embodiments of the invention are characterized by the use of sodium silicate builders or builder mixtures which deviate at least partly from this modulus value, but otherwise lie within the limits mentioned. In this case, preferred embodiments are characterized in that at least 5% by weight and, more particularly, at least 10 to 20% by weight of the X-ray amorphous sodium silicate builder deviates from the modulus value of 2.

The microporous beads of useful material according to the invention with their content of alkali metal silicate are distinguished by high BET surfaces (DIN 66131) and by high cumulative volume values (DIN 66133). The BET surface of particularly useful mixtures according to the invention (primary drying product) is at least about 5 $m^2/g$, particular significance attaching to lower limits to the BET surface of at least about 7.5 $m^2/g$ and, more particularly, at least about 10 $m^2/g$. The cumulative volume of the primary drying product is generally at least 50 $mm^3/g$ and preferably at least 100 $mm^3/g$. In special cases, however, it may even reach higher values, for example of 150 $mm^3/g$.

When used as builders in laundry detergents, the mixtures according to the invention are distinguished by improved performance properties. In addition to the improvement in primary washing power, the improvement in incrustation prevention and hence the improvement in so-called secondary washing power, for example of laundry detergents, are particularly noticeable.

Although the dissolving rate of the primary drying product is determined by the second and third components used as mixture components, it is generally high. Thus, the primary drying product has a dissolving rate of at most about 2 minutes and preferably about 1 minute under standard conditions (95% by weight/40° C.).

The absorption capacity of the primary drying product for liquid components is surprisingly high. For example, at least 40% by weight to 50% by weight, based on primary drying product, of liquid components, such as corresponding nonionic surfactants, can be applied in suitable mixing units or simply by spraying. In important embodiments, liquid components can be absorbed in even larger quantities and largely incorporated in the interior of the grain.

It is characteristic of the X-ray amorphous drying products as defined in accordance with the invention that microcrystalline components can be detected by electron diffraction. This applies in particular to relatively heavily overdried products which have been dried, for example, at temperatures of at most 500° C. and preferably at temperatures of 120° to 450° C. In the context of the present invention, microcrystallinity means that, although short-range orders of the individual structural elements are present, overlapping long-range orders are missing, so that no reflexes appear in the X-ray diffraction spectrum, enabling the silicates to be characterized as X-ray amorphous.

The scope of the present invention also encompasses builder components according to the invention in the form of the primary drying product which have been charged in a secondary step with other, more particularly free-flowing components from the field of wetting agents and detergents. Particular significance is attributed to the microporous builders for binding and absorbing liquid components from the production of detergents. Examples of such components include nonionic surfactant compounds which are liquid at room temperature or moderately elevated temperatures, water-containing anionic surfactant pastes or preparations and also melts or plasticized, highly concentrated anionic surfactants, foam inhibitors, such as silicones and/or paraffins, and also fabric softener formulations for use in domestic and institutional detergents. Not only does the thorough mixing of the liquid components with the inorganic carrier component of large specific surface and the possibility of maintaining this mixed state throughout the production of, the detergents ensure the required solidification of the mixture of useful materials, the function of the particular useful-material component is also safeguarded during incorporation in the aqueous wash liquor by the highly water-soluble builder component with its large specific surface. The builder components used in accordance with the invention all have high calcium and magnesium binding capacities, generally of at least 4 mval/g product (expressed as the water-free alkali metal silicate). The ability even of active substances sensitive to water hardness to function on initial contact with surrounding aqueous phase in the wash liquor is thus optimized and guaranteed. It can immediately be seen that important starting aids are thus provided for the following steps of the washing process. However, this also explains a crucial aspect in which the teaching according to the invention differs from the prior art: the particulate form of the builder components based on sodium silicate described in accordance with the invention is characterized inter alia by the large accessible surface associated with the microporous structure. So far as the reaction by which the detergent mixture dissolves in the wash liquid and the primary reactions involved in the interaction between the aqueous liquor and the mixture of useful materials are concerned, this leads to important advantages over comparable mixtures in which the builder components are present or used in the form of small, largely rounded particles with—overall—a significantly reduced surface.

The mixing of the builder components according to the invention based on the microporous and highly absorbent multicomponent mixtures in the form of the primary drying product provides for the largely free adjustability of the charged end product ultimately obtained. Through the absorption of the useful materials and/or auxiliaries in liquid form, the apparent density of the combined material can be freely varied within very wide limits. Thus, the builder components can even be used in modern detergents with apparent densities of at least about 0.7 g/cm$^3$.

Mixture components which may be used in the multicomponent mixtures according to the invention or applied to the primary drying product are listed in the following without any claim to completeness. Basically, the entire range of useful materials and auxiliaries from the field of detergents is available for this purpose, including in particular anionic, nonionic, cationic, amphoteric and/or zwitterionic surfactants and other inorganic and/or organic builders, bleaching agents and bleach activators, enzymes and enzyme stabilizers, foam inhibitors, optical brighteners, inorganic alkaline salts and/or salts reacting neutrally in water, for example sulfates or chlorides, and dyes and fragrances.

Preferred surfactants of the sulfonate type are the known $C_{9-13}$ alkyl benzene sulfonates, olefin sulfonates and alkane sulfonates. Esters of α-sulfofatty acids and the disalts of α-sulfofatty acids are also suitable. Other suitable anionic surfactants are sulfonated fatty acid glycerol esters in the form of monoesters, diesters and triesters and mixtures thereof which are obtained in the esterification of a monoglycerol with 1 to 3 moles of fatty acid or in the transesterification of triglycerides with 0.3 to 2 moles of glycerol.

Suitable surfactants of the sulfate type are the sulfuric acid monoesters of primary alcohols of natural and synthetic origin, more particularly fatty alcohols, for example coconut oil fatty alcohol, tallow fatty alcohol, oleyl alcohol, lauryl, myristyl, cetyl or stearyl alcohol, or the $C_{10-20}$ oxo alcohols and those of secondary alcohols with the same chain length. Sulfuric acid monoesters of alcohols ethoxylated with 1 to 6 moles of ethylene oxide, such as 2-methyl—branched $C_{9-11}$ alcohols containing on average 2 or 3.5 moles of ethylene oxide are also suitable.

Preferred anionic surfactant mixtures contain combinations of alk(en)yl sulfates, more particularly mixtures of saturated and unsaturated fatty alcohol sulfates, and alkyl benzene sulfonates, sulfonated fatty acid glycerol esters and/or α—sulfofatty acid esters and/or alkyl sulfosuccinates. Mixtures containing alk(en)yl sulfates and alkyl benzene sulfonates and optionally α-sulfofatty acid methyl esters and/or sulfonated fatty acid glycerol esters as anionic surfactants are particularly preferred.

Other suitable anionic surfactants are, in particular, soaps, preferably in quantities below 5% by weight. Suitable soaps are saturated fatty acid soaps, such as the salts of lauric acid, myristic acid, palmitic acid or stearic acid, and soap mixtures derived in particular from natural fatty acids, for example coconut oil, palm kernel oil or tallow fatty acids. Unsaturated fatty acid soaps derived, for example, from oleic acid may also be present, although they should not make up more than 50% by weight of the soaps.

The anionic surfactants and soaps may be present in the form of their sodium, potassium or ammonium salts and as soluble salts of organic bases, such as mono-, di- or triethanolamine. The anionic surfactants are preferably present in the form of their sodium or potassium salts, more particularly in the form of their sodium salts. The anionic surfactant content of the detergents is generally between 5 and 40% by weight.

Preferred nonionic surfactants are alkoxylated, advantageously ethoxylated, alcohols, more particularly primary alcohols, preferably containing 8 to 18 carbon atoms and, on average, 1 to 12 moles of ethylene oxide (EO) per mole of alcohol, in which the alcohol radical may be linear or preferably 2—methyl—branched or may contain linear and methyl—branched radicals in admixture in the form in which they are typically present in oxo alcohol radicals. However, alcohol ethoxylates with linear residues of alcohols of native origin containing 12 to 18 carbon atoms, for example from coconut oil, palm kernel oil, tallow fatty or oleyl alcohol, and on average 2 to 8 EO per mole of alcohol are particularly preferred. Preferred ethoxylated alcohols include, for example, $C_{12-14}$ alcohols containing 3 EO or 4 EO, $C_{9-11}$ alcohol containing 7 EO, $C_{13-15}$ alcohols containing 3 EO, 5 EO, 7 EO or 8 EO, $C_{12-18}$ alcohols containing 3 EO, 5 EO or 7 EO and mixtures thereof, such as mixtures of $C_{12-14}$ alcohol containing 3 EO and $C_{12-18}$ alcohol containing 5 EO. The degrees of ethoxylation mentioned are statistical mean values which can be a whole number or a broken number for a particular product. Preferred alcohol ethoxylates have a narrow-range homolog distribution (narrow range ethoxylates, NRE). In addition to these nonionic surfactants, fatty alcohols containing more than 12 EO may also be used. Examples of such fatty alcohols are tallow fatty alcohol containing 14 EO, 25 EO, 30 EO or 40 EO.

Other suitable nonionic surfactants are alkyl glycosides corresponding to the general formula $RO(G)_x$, in which R is a primary linear or methyl-branched, more particularly 2-methyl-branched, aliphatic radical containing 8 to 22 and preferably 12 to 18 carbon atoms and G is a glycose unit containing 5 or 6 carbon atoms, preferably glucose. The degree of oligomerization x, which indicates the distribution of monoglycosides and oligoglycosides, is a number of 1 to 10 and preferably assumes a value of 1.2 to 1.4.

Other suitable surfactants are polyhydroxy fatty acid amides corresponding to formula (I):

$$R^2-CO-\overset{\overset{\displaystyle R^3}{|}}{N}-[Z] \qquad (I)$$

in which $R^2CO$ is an aliphatic acyl group containing 6 to 22 carbon atoms, $R^3$ is hydrogen, an alkyl or hydroxyalkyl group containing 1 to 4 carbon atoms and [Z] is a linear or branched polyhydroxyalkyl group containing 3 to 10 carbon atoms and 3 to 10 hydroxyl groups.

The percentage content of nonionic surfactants in the detergents is generally from 2 to 25% by weight.

Any of the builders hitherto commonly used may be present as further inorganic builders. These include in particular zeolites, crystalline layer silicates, even phosphates, providing they are ecologically safe to use. Their content may vary over a wide range, depending on the content of the X-ray amorphous, overdried shard silicates according to the invention. The sum total of conventional builders and the silicates according to the invention is normally from 10 to 60% by weight.

Useful organic builders, which may even be used separately from the alkali metal silicates and/or in combination with corresponding compounds, are for example the above-mentioned polycarboxylic acids preferably used in the form of their sodium salts, such as citric acid, adipic acid, succinic acid, glutaric acid, tartaric acid, sugar acids, aminocarboxylic acids and nitrilotriacetic acid (NTA).

Suitable polymeric polycarboxylates are the groups of salts mentioned above, for example the sodium salts of polyacrylic acid or polymethacrylic acid, for example those with a relative molecular weight of 800 to 150,000 (based on acid). Suitable copolymeric polycarboxylates are, in particular, those of acrylic acid with methacrylic acid and of acrylic acid or methacrylic acid with maleic acid. Further particulars can be found in the foregoing observations on these classes of compounds.

Among the compounds yielding $H_2O_2$ in water which serve as bleaching agents, sodium perborate tetrahydrate and sodium perborate monohydrate are particularly important. Other useful bleaching agents are, for example, sodium percarbonate, peroxypyrophosphates, citrate perhydrates and also $H_2O_2$-yielding peracidic salts or peracids, such as perbenzoates, peroxophthalates, diperazelaic acid or diperdodecanedioic acid. The content of bleaching agents in the detergents is preferably from 5 to 25% by weight and more preferably from 10 to 20% by weight, perborate monohydrate advantageously being used.

To obtain an improved bleaching effect where washing is carried at temperatures of 60° C. or lower, bleach activators may be incorporated in the detergents. Examples of bleach activators are N-acyl or O-acyl compounds which form organic peracids with $H_2O_2$, preferably N,N'-tetraacy-lated diamines, and also carboxylic anhydrides and esters of polyols, such as glucose pentaacetate. Other known bleach activators are acetylated mixtures of sorbitol and mannitol of the type described, for example, in European patent application EP-A-0 525 239. The content of bleach activators in the detergents containing bleaching agents is in the usual range, preferably from 1 to 10% by weight and more preferably from 3 to 8% by weight. Particularly preferred bleach activators are N,N,N',N'-tetraacetyl ethylenediamine (TAED), 1,5-diacetyl-2,4-dioxohexahydro-1,3,5-triazine (DADHT) and acetylated sorbitol/mannitol mixtures (SORMAN).

It can be of advantage to add typical foam inhibitors to the detergents where they are used in washing machines. Suitable foam inhibitors are, for example, soaps of natural or synthetic origin with a high percentage content of $C_{18-24}$ fatty acids. Suitable non-surface-active foam inhibitors are, for example, organo-polysiloxanes and mixtures thereof with microfine, optionally silanized silica and also paraffins, waxes, microcrystalline waxes and mixtures thereof with silanized silica or bis—stearyl ethylenediamide. Mixtures of various foam inhibitors, for example mixtures of silicones, paraffins or waxes, may also be used with advantage. The foam inhibitors, more particularly silicone-or paraffin-containing foam inhibitors, are preferably fixed to a granular water-soluble or water-dispersible support. Mixtures of paraffins and bis-stearyl ethylene-diamides are particularly preferred.

Suitable enzymes are those from the class of proteases lipases, amylases, cellulases and mixtures thereof. Enzymes obtained from bacterial strains or fungi, such as *Bacillus subtilis, Bacillus licheniformis* and *Streptomyces griseus*, are particularly suitable. Proteases of the subtilisin type, more particularly proteases obtained from *Bacillus lentus*, are preferably used. Enzyme mixtures, for example of protease and amylase or protease and lipase or protease and cellulase or of cellulase and lipase or of protease, amylase and lipase or protease, lipase and cellulase, but especially cellulase-containing mixtures, are of particular interest. Peroxidases or oxidases have also proved to be suitable in some cases. The enzymes may be fixed to supports and/or encapsulated in shell—forming substances to protect them against premature decomposition. The percentage content of enzymes, enzyme mixtures or enzyme granules may be, for example, from about 0.1 to 5% by weight and is preferably from 0.1 to about 2% by weight.

Suitable stabilizers, more particularly for per compounds and enzymes, are the salts of polyphosphonic acids, more particularly 1-hydroxyethane-1, 1-diphosphonic acid (HEDP), diethylenetriamine pentamethylene phosphonic acid (DETPMP) or ethylenediamine tetramethylene phosphonic acid (EDTMP).

The function of redeposition inhibitors is to keep the soil detached from the fibers suspended in the liquor and thus to prevent discoloration. Suitable redeposition inhibitors are water-soluble, generally organic colloids, for example the water-soluble salts of polymeric carboxylic acids, glue, gelatine, salts of ether carboxylic acids or ether sulfonic acids of starch or cellulose or salts of acidic sulfuric acid esters of cellulose or starch. Water-soluble polyamides containing acidic groups are also suitable for this purpose. Soluble starch preparations and other starch products than those mentioned above, for example degraded starch, aldehyde starches, etc. may also be used. Polyvinyl pyrrolidone is also suitable. However, cellulose ethers, such as carboxymethyl cellulose (Na salt), methyl cellulose, hydroxyalkyl cellulose and mixed ethers, such as methyl hydroxyethyl cellulose, methyl hydroxypropyl cellulose, methyl carboxymethyl cellulose and mixtures thereof, and also polyvinyl pyrrolidone are preferably used, for example in quantities of 0.1 to 5% by weight, based on the detergent.

The detergents may contain derivatives of diaminostilbene disulfonic acid and alkali metal salts thereof as optical brighteners. Suitable optical brighteners are, for example, salts of 4,4'-bis-(2-anilino-4-mor-pholino-1,3,5-triazinyl-6-amino)-stilbene-2,2'-disulfonic acid or compounds of similar structure which contain a diethanolamino group, a methylamino group, an anilino group or a 2-methoxyethylamino group instead of the morpholino group. Brighteners of the substituted diphenylstyryl type, for example alkali metal salts of 4,4'-bis-(2-sulfostyryl)-diphenyl, 4,4'-bis-(4-chloro-3-sulfostyryl) -diphenyl or 4-(4-chlorostyryl)-4'-(2-sulfostyryl) -diphenyl, may also be present. Mixtures of the brighteners mentioned above may also be used.

The apparent density of the preferred granular detergents, which contain the silicates according to the invention and which are impregnated with the other components of standard detergents, is generally in the range from 300 to 1200 g/l and preferably in the range from 500 to 1100 g/l. Detergents with apparent densities of at least 700 g/l are most particularly preferred. They may be produced by any of the known methods, such as mixing, spray drying, granulation and extrusion, the X-ray amorphous overdried silicate compounds according to the invention and preferably the silicate compounds charged with liquid useful materials from the field of detergents, more particularly nonionic surfactants, advantageously being added to and mixed with the other components of the detergent. Processes in which several individual components, for example spray-dried components and granulated and/or extruded components, are mixed with one another are particularly suitable. It is preferred, particularly in granulation and extrusion processes, to use the anionic surfactants optionally present in the form of a spray-dried, granulated or extruded compoundeither as a mixing component to be incorporated in the processes mentioned or as an additive to other granules. It is also possible and—depending on the formulation—can also be of advantage subsequently to add other individual constituents of the detergent, for example carbonates, citrate or citric acid or other polycarboxylates or polycarboxylic acids, polymeric polycarboxylates, zeolite and/or layer silicates, for example layer-form crystalline disilicates, to spray-dried, granulated and/or extruded components.

General knowledge of the art may be used in the production of detergents according to the invention. For example, heat-sensitive components, such as enzymes, readily volatile fragrances and even heat-sensitive percarbonate compounds are incorporated under working conditions which rule out any risk of damage to such components. The presence of alkali metal silicate builders or corresponding builder compounds, which have been produced in accordance with the invention, is crucial to the detergents with which the teaching of the invention is concerned.

EXAMPLES

Example 1

An aqueous solution of waterglass and soda is spray-dried with superheated steam in a Niro-Atomizer "Minor Production" pilot-scale experimental spray drying tower. The aqueous solution of the useful-material mixture to bedried is sprayed through a two-component nozzle with superheated steam as the propellent gas.

For mixing the useful materials, the sodium carbonate was dissolved in distilled water at around 80° C. to form a clear solution and added to the waterglass present in the form of an aqueous preparation. A mixing ratio of 1:1, based on dry matter (DM), is established for the two components waterglass and soda as $Na_2CO_3.10H_2O$.

DM content of the solution: 37% by weight pH value of the aqueous preparation: 12.2

The waterglass in the aqueous preparation to be sprayed has the following characteristic data:

Density Kg/m$^3$: 1,690–1,710

Waterglass modulus: 2.00–2.06

Viscosity mPas/20° C.: >10,000

% By weight water: 44.6–46.2

% By weight $SiO_2$: 36.0–37.0

% By weight $Na_2O$: 17.8–18.4

The following operating parameters were established for drying with superheated steam:

Steam entry temperature: 315° C.

Steam exit temperature: 200° C.

Reduced pressure in tower (mm WC): 40–80

Feed pump pressure: 0.6 bar

Feed temperature: 75° C.

Feed rate: 12 kg/h

Steam throughput: 500 m$^3$/h

Propellent gas (superheated steam) of the two-component nozzle

Quantity: 6.5 kg/h Pressure: 0.3 bar

A free-flowing material in the form of fine white granules with the following parameters is obtained as the end product:

Residual moisture content at 140° C.: 1.0% by weight

Apparent density: 420 g/l

Solubility in water (90%/20° C.): 30 secs.

Example 2

An aqueous preparation of waterglass, soda and sodium citrate is sprayed-dried with superheated steam as the drying gas in the spray drying tower of Example 1. The following mixing ratio (expressed. as DM) is established:

45% by weight of waterglass, 10% by weight of $Na_2CO_3.10H_2O$ and

45% by weight of $C_6H_5O_7Na_3.2H_2O$

To prepare the aqueous preparation to be spray dried, the sodium carbonate was dissolved with the trisodium citrate in distilled water at around 80° C. to form a clear solution which was then added to the waterglass.

The aqueous preparation to be spray dried has the following characteristic data:

DM content of the solution: 53% by weight pH value: 12.2

Waterglass modulus: 2.00–2.06

The following operating parameters were established for drying with superheated steam:

Steam entry temperature: 320° C.

Steam exit temperature: 203° C.

Reduced pressure in tower (mm WC): 80

Feed pump pressure: 0.8 bar

Feed temperature: 75° C.

Feed rate: 14 kg/h

Steam throughput: 500 m$^3$/h

Propellent gas (superheated steam) of the two-component nozzle

Quantity: 6.5 kg/h

Pressure: 0.4 bar

A free-flowing material in the form of granules with a residual moisture content (140° C.) of 1.2% by weight and an apparent density of 155 g/l is obtained. It has a dissolving rate in water (90% by weight/20° C.) of 98 seconds.

What is claimed is:

1. A solid material comprising alkali metal silicates having molar ratio of $SiO_2$ to $M_2O$ of 0.8 to 4 wherein M is an alkali metal in homogeneous admixture with an inorganic or organic material wherein said solid material contains at least 10% by weight of water-soluble inorganic or organic salts as the inorganic or organic material, has an apparent density of at least 150 g/l and a BET surface of at least 5 m$^2$, said alkali metal silicates having a water content of less than 15% by weight and at least 50% by weight of the alkali metal silicates are present in the form of a chain, ring or flat structure, but not three-dimensionally cross-linked ($Q_2$ or $Q_3$ structure).

2. A solid material as in claim 1 wherein said alkali metal silicates have a water content of 1% to 13% by weight.

3. A solid material as in claim 1 wherein said alkali metal silicates are present in an amount of at least 25% by weight, and said inorganic or organic material is present in an amount of at least 15% by weight, based on the weight of said solid material.

4. A solid material as in claim 1 wherein said alkali metal silicates and said inorganic or organic materials are present as sodium or potassium salts.

5. A solid material as in claim 1 wherein the solubility in water of said alkali metal silicates at ambient temperature is such that the percentage content of insoluble material is less than 3% by weight.

6. A solid material as in claim 1 wherein said alkali metal silicates are X-ray amorphous.

7. A solid material as in claim 1 wherein said water-soluble inorganic or organic material is present as an alkali metal salt in the form of the corresponding carbonates, sulfates, halides, phosphates, polyphosphates, borates, or salts of lower, polybasic carboxylic acids or polymeric polycarboxylic acids or copolymers thereof.

8. A solid material as in claim 1 wherein said solid material is impregnated with detergent composition components.

9. A solid material as in claim 8 wherein said detergent composition components are selected from nonionic surfactants, anionic surfactants, fabric softeners, foam inhibitors, and mixtures thereof.

10. A detergent composition containing a solid material comprising alkali metal silicates having a molar ratio of $SiO_2$ to $M_2O$ of 0.8 to 4 wherein M is an alkali metal in homogeneous admixture with an inorganic or organic material wherein said solid material contains at least 10% by weight of water-soluble inorganic or organic salts as the inorganic or organic material, has an apparent density of at least 150 g/l and a BET surface of at least 5 $m^2$, said alkali metal silicates having a water content of less than 15% by weight and at least 50% by weight of the alkali metal silicates are present in the form of a chain, ring or flat structure, but not three-dimensionally cross-linked (Q2 or $Q_3$ structure).

11. A detergent composition as in claim 10 wherein said metal silicates have a water content of 1% to 13% by weight.

12. A detergent composition as in claim 10 wherein said alkali metal silicates are present in an amount of at least 25% by weight, and said inorganic or organic material is present in an amount of at least 15% by weight, based on the weight of said solid material.

13. A detergent composition as in claim 10 wherein said alkali metal silicates and said inorganic or organic materials are present as sodium or potassium salts.

14. A detergent composition as in claim 10 wherein the solubility in water of said alkali metal silicates at ambient temperature is such that the percentage content of insoluble material is less than 3% by weight.

15. A detergent composition as in claim 10 wherein said alkali metal silicates are X-ray amorphous.

16. A detergent composition as in claim 10 wherein said water-soluble inorganic or organic material is present as an alkali metal salt in the form of the corresponding carbonates, sulfates, halides, phosphates, polyphosphates, borates, or salts of lower, polybasic carboxylic acids or polymeric polycarboxylic acids or copolymers thereof.

17. A detergent composition as in claim 10 wherein said solid material is impregnated with detergent composition components.

18. A detergent composition as in claim 17 wherein said detergent composition components are selected from nonionic surfactants, anionic surfactants, fabric softeners, foam inhibitors, and mixtures thereof.

19. The process of producing a solid material comprising drying with superheated steam a homogeneous admixture of alkali metal silicates having a molar ratio of $SiO_2$ to $M_2O$ of 0.8 to 4 wherein M is an alkali metal and an inorganic or organic material to provide a solid material containing at least 10% by weight of water-soluble inorganic or organic salts as the inorganic or organic material, an apparent density of at least 150 g/l and a BET surface of at least 5 $m^2$, said alkali metal silicates having a water content of less than 15% by weight and at least 50% by weight of the alkali metal silicates are present in the form of a chain, ring or flat structure, but not three-dimensionally cross-linked ($Q_2$ or $Q_3$ structure).

20. A process as in claim 19 wherein said drying is conducted by spray drying.

21. A process as in claim 19 wherein said drying is conducted in a fluidized bed.

22. A process as in claim 19 wherein said drying is carried out in the absence of $CO_2$ in a drying zone and a drying gas stream is a circulated stream of the superheated steam removed from a drying zone which has been reheated by the indirect input of energy.

23. A process as in claim 19 wherein said superheated steam has a temperature on entering a drying zone of 280° C. to 380° C. and a temperature on leaving the drying zone of 180° C. to 240° C.

* * * * *